United States Patent [19]

Engle

[11] 3,942,837

[45] Mar. 9, 1976

[54] REINFORCED CONTAINER DIVIDER

[75] Inventor: Donald W. Engle, Wauwatosa, Wis.

[73] Assignee: Clevepak Corporation, New York City, N.Y.

[22] Filed: Jan. 2, 1975

[21] Appl. No.: 537,944

[52] U.S. Cl. ..... 229/15; 217/31
[51] Int. Cl.[2] ..... B65D 5/48; B65D 25/04
[58] Field of Search ..... 229/15; 217/15, 21, 22, 217/23, 31, 32

[56] References Cited

UNITED STATES PATENTS

| | | | |
|---|---|---|---|
| 2,920,782 | 1/1960 | Butters | 217/32 |
| 3,384,289 | 5/1968 | Grant | 229/15 |
| 3,519,191 | 7/1970 | Royce | 229/15 X |

*Primary Examiner*—Davis T. Moorhead
*Attorney, Agent, or Firm*—Rogers, Ezell & Eilers

[57] ABSTRACT

A divider for use in a container, such as a corrugated cardboard box, has a network of intersecting partitions and reinforced folded structures at the ends of the partitions. The reinforcing structures are folded to the main body of the partitions, forming areas of increased thickness which increase the compressive strength of the divider and a container having the divider included therein. The partitions are slotted and interlocked together by use of the slots. The slots have relieved areas at the entrance to the slots and an interlocking protrusion. The opposite edges of the partitions from the slots have relieved areas. The relieved areas at the slot entrances facilitate entry of the strips into the slots and interlocking of the strips together. The protrusions mate with the relieved areas on the intersecting strips and stabilize the partition against substantial relative movement parallel to the slots and also stabilize the strips against any substantial relative movement in a direction perpendicular to the slots. The divider is made by cutting conventional cardboard stock using a conventional die cutting machine. The die cutting machine cuts partitions, the relieved areas, and the slots and scores the ends of the partitions. After the partitions have been cut and scored, they then are passed by a conventional glue mechanism, either a glue pot, brush, or an air gun glue applicator, which applies glue to the area of the partitions between the scores and the ends of the partitions. The partitions are then passed through a plow which folds the partitions along the scored lines. The folded partitions are passed through calender rolls which press the glued areas against the main body of the partitions, forming a firm bond in the folded over areas between the folded structures and the main body of the partitions.

8 Claims, 4 Drawing Figures

REINFORCED CONTAINER DIVIDER

BACKGROUND AND SUMMARY OF THE INVENTION

Conventional containers, such as corrugated cardboard boxes, have the interior divided into a plurality of sections or spaces by cardboard dividers. These spaces are then used to hold bottles, cans, or a variety of other articles which need to be stored or shipped. The primary strength of conventional containers and dividers is furnished by the walls of the cardboard container itself, by the physical articles contained therein, and by the divider. Articles which have no substantial strength or which must be protected from crushing or penetrating forces must rely on the strength of the container and the divider for protection.

In the past, to provide adequate protection for fragile goods, it has been necessary to thicken the walls of the container. If the container walls were not thickened, they would buckle under the weight of other stacked containers and would allow penetration and crushing from externally applied forces. Increasing the wall thickness of the container has the disadvantage of requiring more material in the walls of the container for any given unit of strength, thereby increasing the cost of the packaging for the articles transported or stored.

Applicant has devised a new divider for use in containers, such as cardboard corrugated containers, which greatly increases the compressive strength of the containers from weight loads occasioned by stacking and strengthens the containers from forces tending to penetrate or crush the container walls. Applicant's new divider and a container using the divider incorporated therein need not have the wall thickness of the cardboard container increased. As a result, the container using applicant's divider is very economical in the use of materials for the incremental strength added.

Applicant achieves this increase in strength by folding over the ends of the divider partitions at locations adapted to lie adjacent to the walls of a container and then glueing the folded ends back into the main body of the partitions. The glued folded ends form areas of increased wall thickness. These thickened areas stiffen the ends of the partitions and prevent buckling of the divider or partitions under vertical loads, thereby increasing the total compressive strength of the divider as a whole and of a container having the divider incorporated therein. The partitions, on being placed in a container resist against compressive forces and resist penetration of objects into and through the container wall.

DESCRIPTION OF THE PREFERRED EMBODIMENTS

Figure 1:
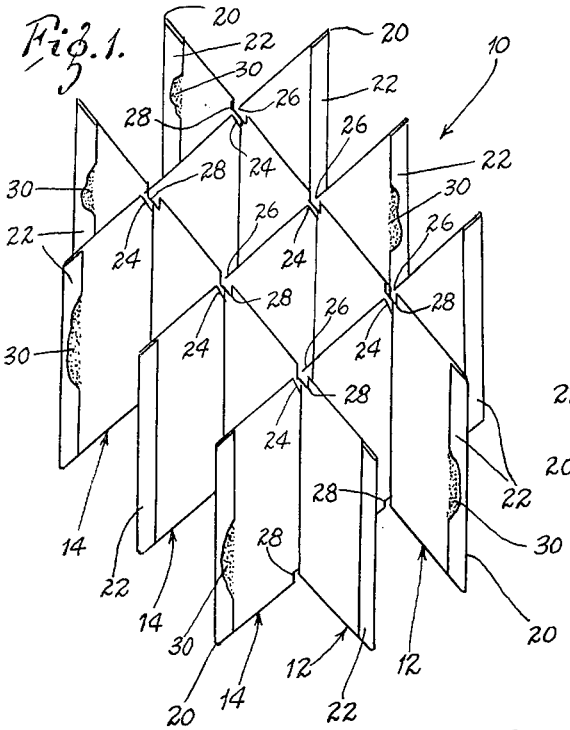
FIG. 1 is an isometric view of a divider incorporating the concepts of the invention.
Figure 3:
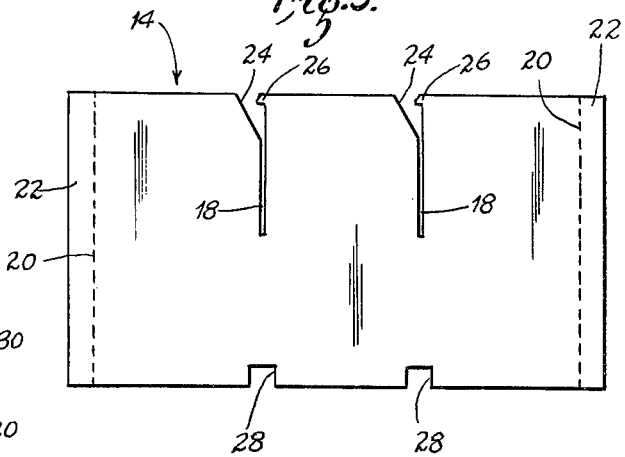
FIG. 3 is a transverse partition utilized in the divider of FIG. 1.
Figure 2:
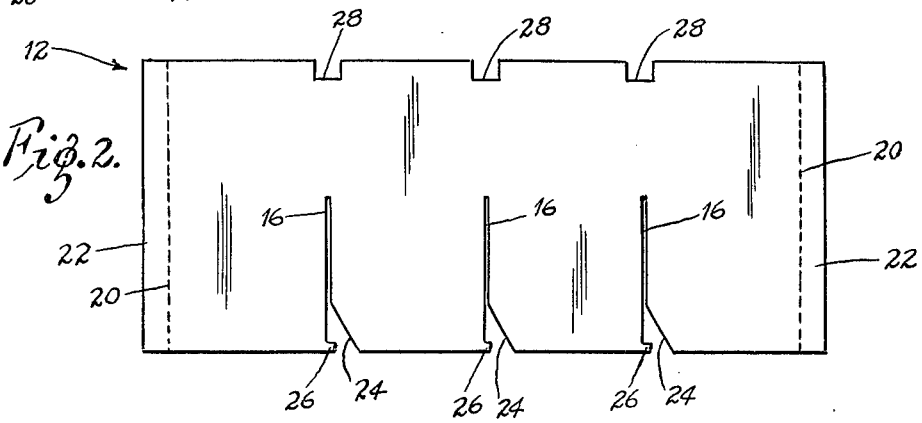
FIG. 2 is a plan view of a longitudinal partition strip utilized in the divider of FIG. 1.

Referring in more detail to the drawings, FIG. 1 shows a divider 10 for use in dividing a container into twelve sections of equal volume. The divider 10 is formed of two longitudinal partitions 12 and three transverse partitions 14. Partitions 12, shown in FIG. 2, have three slots 16 extending transversely across the partitions approximately one half of the transverse dimension. Partitions 14 each have two slots extending transversely across the partitions 14 approximately half their transverse dimension. Slots 16 and 18 are cut on alternating sides, slots 16 being on top, slots 18 being on the bottom, so that the divider 10 may be formed by interlocking slots 16 and 18 of strips 12 and 14. At the entrance to slots 16 and 18 are relieved portions 24 and outwardly extending projections 26 overlying the relieved portions 24. At the opposite edge of partitions 12 and 14 from slots 16 and 18 are relieved portions 28. Relieved portions 26 are cut on an incline to facilitate ease of insertion of the partition strips 12 and 14 into slots 16 and 18 and facilitate interlocking of the strips to form divider 10. Outwardly extending projections 26 cooperate with relieved areas 28 of the adjacent interlocking partition strip to hold the partitions fixed and prevent any substantial relative movement between interlocking strips 12 and 14 in the directions parallel and perpendicular to slots 16 and 18.

Spaced inwardly from the ends of partitions 12 and 14 are score lines 20 which are placed inwardly a short distance, typically one half inch to one inch from the ends of the partitions 12 and 14. These score lines separate off areas 22 at the ends of the partitions 12 and 14 which are to be folded back to form the vertical stiffening elements. Areas 22 are adhered to the main body of partitions 12 and 14 by glue bond 30.

Figure 4:
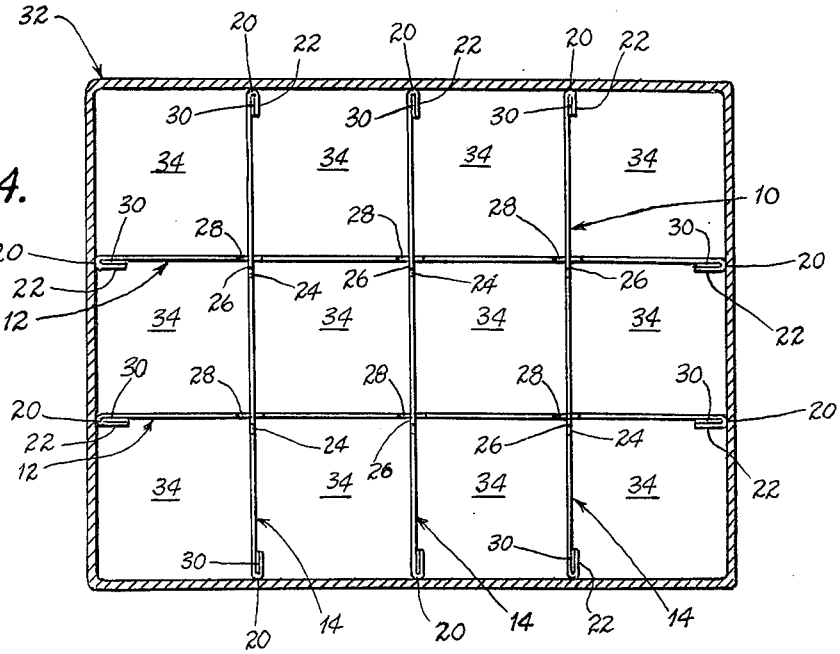
FIG. 4 is a top view partially in section of a container having the divider of FIG. 1 incorporated therein.

When placed in a container such as a corrugated container shown at 32 in FIG. 4, the divider 10 divides the container into twelve equal volume spaces 34. The vertical reinforcing and stiffening members 22 at the extremities of partitions 12 and 14 are spaced closely adjacent to the walls of container 32, act to reinforce the container and prevent buckling thereof and to reinforce the divider 10 and the container 32 from vertical loads, and reinforce the container and prevent penetration thereof by forces normal to the container walls.

To manufacture divider 10, elements 12 and 14 are cut from conventional cardboard stock and scored on a conventional die cutting machine. Slots 16 and 18; relieved portions 24, 26, and 28, and scored lines 20 are formed by the die cutting operation. The cut and scored partitions 12 and 14 are then glued in area 22 between scored line 20 and the ends of partitions 12 and 14. Glue bond 30 can also be applied to the main body of the partitions adjacent to scores 20, if desired. The cut, scored and glued partitions are then transported past a plow which bends and folds partitions 12 and 14 along score lines 20 and folds area 22 over adjacent to the main body of partitions 12 and 14. The glued, folded partitions 14 and 16 are then calendered to adhere glue bond 30 and area 22 to the main body of the partitions 12 and 14 to form reinforced portions at the ends of the partitions 12 and 14.

It will be appreciated by one skilled in the art that many modifications may be made in the invention as disclosed herein without departing from the basic concepts of the invention. It is intended that the invention is not to be limited by the description given herein, which is for purposes of illustration, but is to be limited only by the scope of the appended claims.

I claim:

1. A divider for use in a container to divide the internal space of the container having a first partition extending in a first direction and a second partition extending in a direction intersecting the first partition, at least one of the partitions having a score extending transversely of the partition and spaced adjacent to an extremity of the partition, the portion of the partition between the score and the extremity being folded back along the score and joined by a glue bond to the main body of the partition to form an area of increased thickness at an end of the partition to reinforce the partition and strengthen the partition against externally applied forces.

2. A partition for use in a container to divide the internal space of the container having a score extending transversely of the partition and spaced adjacent to an extremity of the partition, the portion of the partition between the score and the extremity being folded back along the score and joined by a glue bond to the main body of the partition to form an area of increased thickness at an end of the partition to reinforce the partition and strengthen the partition against externally applied forces.

3. The divider of claim 1 wherein the partitions are joined by interlocking slots.

4. The divider of claim 3 wherein the interlocking slots have relieved portions adapted to facilitate assembly of the partitions.

5. The divider of claim 3 wherein the partitions have means restricting relative movement of the partitions.

6. A divider for use in a container to divide the internal space of the container and reinforce the container having a plurality of partitions extending in a first direction and at least one partition extending in a direction intersecting the first partitions, the partitions having means to interlock into a network to divide into spaces of substantially equal volume, the partitions having cooperating means to restrict relative movement of the partitions, the ends of the partitions having reinforced portions adapted to be positioned closely adjacent to the walls of a container to strengthen the container, the reinforced portions having a score extending transversely of the strips and spaced from the extremity thereof, the area between the score and the extremity of the strip having an adhesive material thereon and being joined to the main body of the strips by the adhesive.

7. A method of forming a container divider comprising cutting a first partition element, slotting the element, scoring the element in a location adjacent to the extremity of the element, applying an adhesive to the element at a location between the score and the extremity of the partition, and joining the adhesive coated portion of the element to the main body of the element by forming an adhesive bond, thereby forming an area of increased strength and rigidity to reinforce force the divider and a container having the divider incorporated therein.

8. The method of claim 7 wherein a plurality of elements are formed and the elements are assembled into a network, and wherein means are formed on the elements to restrict relative movement of the assembled elements.

* * * * *